US009259126B2

(12) United States Patent
Niederman

(10) Patent No.: US 9,259,126 B2
(45) Date of Patent: Feb. 16, 2016

(54) BACKPACK VACUUM CLEANER

(71) Applicant: ELECTROLUX HOME CARE PRODUCTS, INC., Charlotte, NC (US)

(72) Inventor: Robert Raymond Niederman, Concord, NC (US)

(73) Assignee: Electrolux Home Care Products, Inc., Charlotte, NC (US)

( * ) Notice: Subject to any disclaimer, the term of this patent is extended or adjusted under 35 U.S.C. 154(b) by 233 days.

(21) Appl. No.: 13/648,666

(22) Filed: Oct. 10, 2012

(65) Prior Publication Data

US 2014/0096339 A1 Apr. 10, 2014

(51) Int. Cl.

| | |
|---|---|
| ***A47L 9/00*** | (2006.01) |
| ***A47L 5/36*** | (2006.01) |
| ***A47L 9/22*** | (2006.01) |

(52) U.S. Cl.

CPC ..... *A47L 5/36* (2013.01); *A47L 9/0081* (2013.01); *A47L 9/22* (2013.01)

(58) Field of Classification Search

CPC ..... A47L 5/36; A47L 9/00; A47L 9/0054
USPC ..... 15/327.2, 327.5, 326; 417/234, 363, 417/423.2

See application file for complete search history.

(56) References Cited

U.S. PATENT DOCUMENTS

| | | | | |
|---|---|---|---|---|
| 1,921,085 | A * | 8/1933 | Korittke | 96/382 |
| 2,036,694 | A * | 4/1936 | Hansson | 248/603 |
| 2,460,682 | A | 2/1949 | Doughman | |
| D219,835 | S | 2/1971 | Otto et al. | |
| 4,325,162 | A | 4/1982 | Chambers et al. | |
| 5,159,738 | A | 11/1992 | Sunagawa et al. | |
| 5,267,371 | A * | 12/1993 | Soler et al. | 15/327.5 |
| 5,293,664 | A | 3/1994 | Lim et al. | |
| 5,400,463 | A | 3/1995 | Attard et al. | |
| 5,548,867 | A | 8/1996 | Hwang et al. | |
| 5,588,177 | A * | 12/1996 | Eriksen | 15/327.5 |
| D398,426 | S | 9/1998 | Bisson | |
| 6,049,941 | A | 4/2000 | Vollenweider, II | |
| 6,073,301 | A | 6/2000 | Berfield | |
| 6,094,774 | A | 8/2000 | Larsen et al. | |
| 6,151,749 | A | 11/2000 | Berfield | |
| RE37,081 | E | 3/2001 | Eriksen | |
| D446,365 | S | 8/2001 | Bisson | |
| 6,295,692 | B1 | 10/2001 | Shideler | |
| 6,396,656 | B1 | 5/2002 | Satou | |
| D459,039 | S | 6/2002 | Bisson | |

(Continued)

OTHER PUBLICATIONS

Non-Final Office Action for U.S. Appl. No. 29/434,473, May 8, 2013.

*Primary Examiner* — Monica Carter
*Assistant Examiner* — Stephanie Berry
(74) *Attorney, Agent, or Firm* — RatnerPrestia

(57) ABSTRACT

A backpack vacuum cleaner motor mounting assembly having a first housing, a suspension housing, a suction motor, and one or more springs. The first housing has an inlet, outlet and a suspension chamber in it. The suspension housing is at least partly in the suspension chamber, can move a predetermined distance along a suspension direction from a first position to a second position, and is restricted from moving perpendicular to the suspension direction. The suction motor is connected to and moves with the suspension housing. The springs are oriented to bias the suspension housing from the second position to the first position. A backpack vacuum cleaner having a suction motor in a movable suspension housing is also provided.

26 Claims, 9 Drawing Sheets

(56) References Cited

U.S. PATENT DOCUMENTS

| | | | |
|---|---|---|---|
| 6,473,933 | B1 | 11/2002 | Paterson et al. |
| 6,553,610 | B1 | 4/2003 | Shideler |
| 6,568,026 | B2 | 5/2003 | Roy et al. |
| 6,647,586 | B2 | 11/2003 | Rogers et al. |
| 6,779,228 | B2 | 8/2004 | Plomteux et al. |
| D518,927 | S | 4/2006 | Rupp et al. |
| D534,697 | S | 1/2007 | Reick-Mitrisin et al. |
| D537,583 | S | 2/2007 | Crevling, Jr. et al. |
| 7,287,300 | B2 | 10/2007 | Rupp et al. |
| D572,420 | S | 7/2008 | Genoa et al. |
| 7,437,796 | B2 | 10/2008 | Rappin |
| D581,113 | S | 11/2008 | Hoshino et al. |
| 7,509,706 | B2 | 3/2009 | Clarke |
| D599,063 | S | 8/2009 | Catron |
| D601,314 | S | 9/2009 | Catron |
| 7,581,281 | B2 | 9/2009 | Schlapkohl |
| 7,587,785 | B2 | 9/2009 | Arner |
| 7,600,290 | B1 | 10/2009 | Peters |
| 7,721,384 | B2 | 5/2010 | Crevling, Jr. et al. |
| D617,962 | S | 6/2010 | Clepper et al. |
| D618,408 | S | 6/2010 | Clepper et al. |
| D620,655 | S | 7/2010 | Pezzaniti |
| 7,921,962 | B2 | 4/2011 | Liddell |
| D637,775 | S | 5/2011 | Penrow |
| 7,950,103 | B2 | 5/2011 | Williamson et al. |
| 2007/0174992 | A1 | 8/2007 | Murray et al. |
| 2008/0178416 | A1 | 7/2008 | Conrad |
| 2008/0179133 | A1 | 7/2008 | Conrad |
| 2010/0005614 | A1 | 1/2010 | Cochran et al. |
| 2010/0071151 | A1 | 3/2010 | Crevling, Jr. et al. |
| 2010/0223751 | A1 | 9/2010 | Lidell |
| 2011/0289718 | A1 | 12/2011 | Basenberg, Jr. et al. |

* cited by examiner

BACKPACK VACUUM CLEANER

BACKGROUND OF THE INVENTION

1. Field of the Invention

The present invention relates generally to vacuum cleaners that are carried on an operator's body, and more specifically to shock-absorbing and sound-reducing features for such devices.

2. Description of the Related Art

User-wearable vacuum cleaning systems are known in the art. Such systems typically include a vacuum module that is mounted on the user's body, a flexible hose connected to the vacuum module, and a cleaning head connected to the flexible hose. The vacuum module may be mounted on the user's back, waist, or both. For brevity, user-mounted vacuum cleaners are referred to herein generally as "backpack" vacuum cleaners, regardless of where on the body they are mounted.

A backpack vacuum module usually includes a suction motor and a dirt separation system. For example, backpack vacuum cleaners typically use a cord- or battery-operated electric motor that is connected to an impeller to provide a suction motor. The suction motor is located upstream or downstream of a dirt separation system for removing and collecting dust from the airflow. Separation systems can comprise a filter bag, cyclone separator, or the like. Combinations of separation systems, such as a cyclone used in conjunction with pre- and post-motor filters, are also known. Typical backpack vacuum cleaners are illustrated in U.S. Pat. Nos. 5,267,371; 6,073,301; 6,295,692; 6,473,933; and 6,553,610, which are incorporated herein by reference.

The flexible hose and cleaning head provide a fluid conduit from the surface to be cleaned to the vacuum module. The cleaning head often comprises a floor-facing nozzle that is connected to the flexible hose by a rigid pipe that doubles as an operating handle. Other cleaning tools, such as dusting brushes, furniture nozzles, and crevice tools, also may be attached to the flexible hose, as known in the art.

While various prior art devices like the ones described above have been used in the art, there still exists a need to provide alternatives to such devices.

SUMMARY

In one exemplary embodiment, there is provided a backpack vacuum cleaner motor mounting assembly. The assembly may have a first housing having an air inlet, an air outlet, and a suspension chamber located inside the first housing. The assembly may further include a suspension housing at least partially contained within the suspension chamber, and configured to move a predetermined distance, relative to the suspension chamber, along a suspension direction from a first position to a second position. The suspension housing also may be substantially restricted from moving, relative to the suspension chamber, perpendicular to the suspension direction. A suction motor may be connected to and movable with the suspension housing, and have a suction motor inlet in fluid communication with the air inlet, and a suction motor outlet in fluid communication with the air outlet. One or more springs may be operatively positioned between the first housing and the suspension housing. The one or more springs may be oriented to bias the suspension housing from the second position towards the first position. The backpack vacuum cleaner motor mounting assembly may also include one or more damper assemblies operatively positioned between the first housing and the suspension housing. The dampers may be configured to generate a damping force in response to relative movement between the suspension housing and the first housing.

In another exemplary embodiment, there is provided a backpack vacuum cleaner module. The module may include a filtration chamber having a filtration chamber inlet and a filtration chamber outlet. The filtration chamber inlet may be configured for connection to a suction hose. The module also may have a motor module housing having a motor module inlet in fluid communication with the filtration chamber outlet, and a motor module outlet. The module also may have a suspension chamber located in the motor module housing and in fluid communication between the motor module inlet and the motor module outlet. The module also may have a suspension housing at least partially contained within the suspension chamber. The suspension housing may be configured to move a predetermined distance, relative to the suspension chamber, along a suspension direction from a first position to a second position, and the suspension housing may be substantially restricted from moving, relative to the suspension chamber, perpendicular to the suspension direction. A suction motor may be connected to and movable with the suspension housing. The suction motor may have a suction motor inlet in fluid communication with the motor module inlet and a suction motor outlet in fluid communication with the motor module outlet. One or more springs may be operatively positioned between the motor module housing and the suspension housing and oriented to bias the suspension housing from the second position towards the first position.

The recitation of this summary of the invention is not intended to limit the claims of this or any related or unrelated application. Other aspects, embodiments, modifications to and features of the claimed invention will be apparent to persons of ordinary skill in the art in view of the disclosures herein.

BRIEF DESCRIPTION OF THE DRAWINGS

A better understanding of the exemplary embodiments may be understood by reference to the attached drawings, in which like reference numbers designate like parts. The drawings are exemplary and not intended to limit the claims in any way.

DETAILED DESCRIPTION

The exemplary embodiments described herein relate to vacuum cleaner systems that are configured to be worn on an operator's body. Such "backpack" vacuum cleaners may be mounted on the user's back and/or waist, or elsewhere. Backpack vacuum cleaners also may be convertible use without being mounted on the operator (e.g., as a canister or upright vacuum cleaner).

It has been found that backpack vacuum cleaners present various unique issues as compared to other kinds of vacuum cleaner. For example, backpack vacuum cleaners are operated with the vacuum module above the ground, leading to frequent dropping and sometimes dropping from relatively great heights. Also, the vacuum module usually is much closer to the operator's ears than an upright or canister vacuum, which can significantly increase the perceived amplitude of sounds generated by the vacuum module. These issues are magnified by the fact that backpack vacuum cleaners are commonly used in commercial settings, where the operator may use the vacuum cleaner for many hours nearly every day, and drop the vacuum cleaner from various heights multiple times per day. Further adding to these problems is the desire to make backpack vacuums as light as possible to limit user fatigue. The exemplary embodiments described herein may address one or more of the foregoing problems, but it will be understood that the claimed inventions are not intended to be limited to addressing any particular problem or providing any particular quantified benefit.

Figure 1:
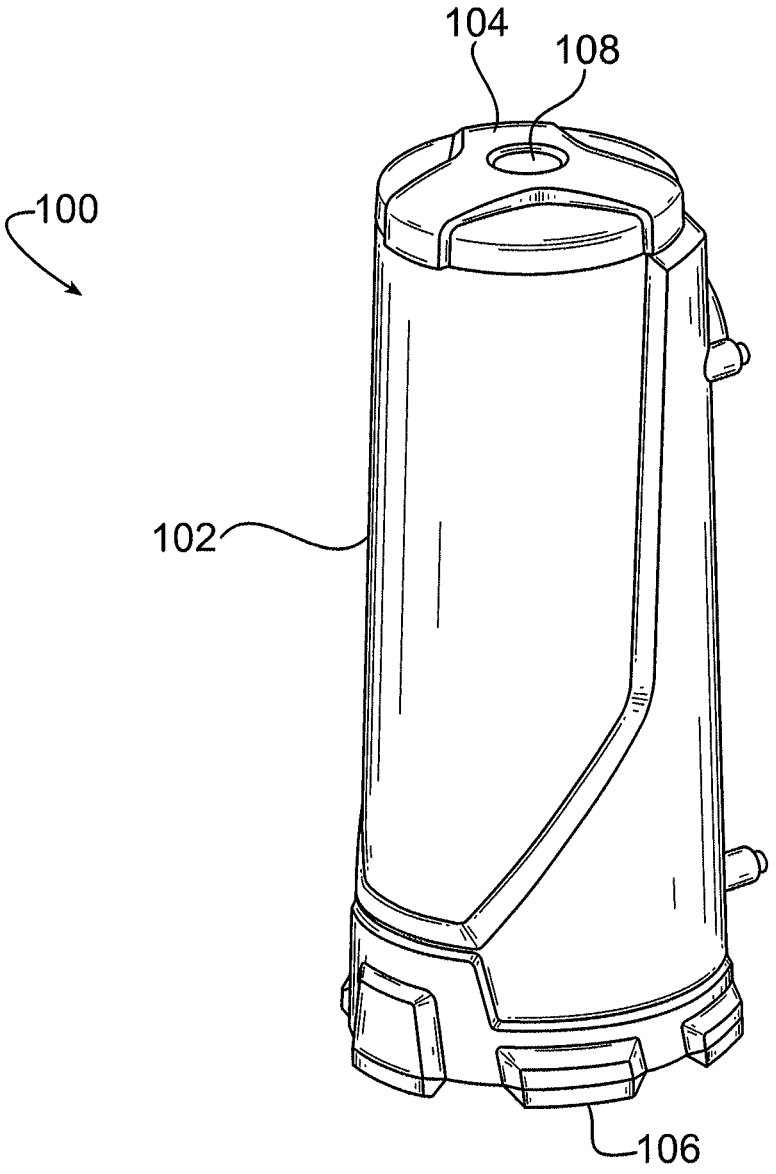
FIG. 1 is an isometric view of a first embodiment of a backpack vacuum module.
Figure 2:
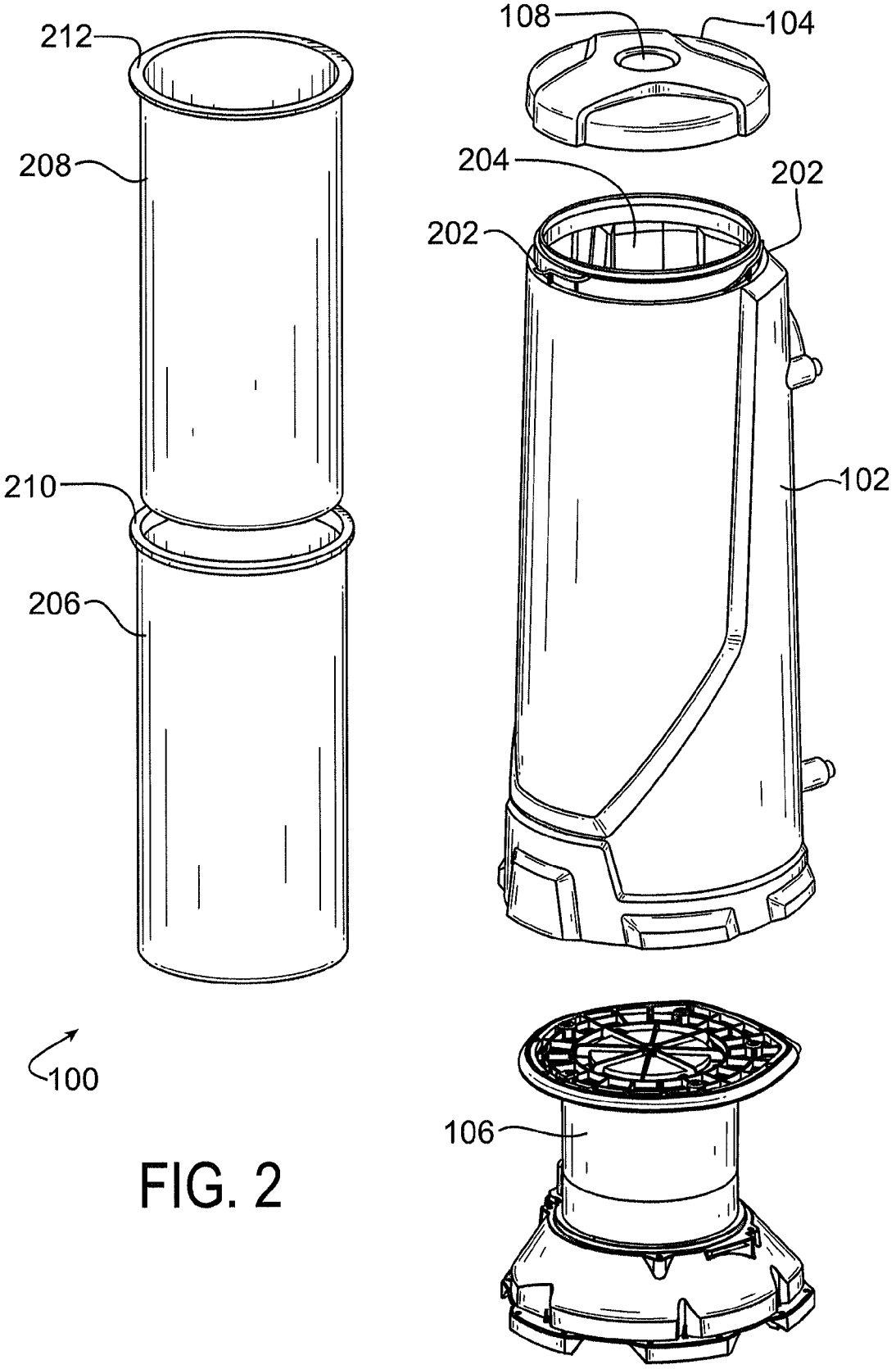
FIG. 2 is a partially-exploded view of the embodiment of FIG. 1.
Figure 3:
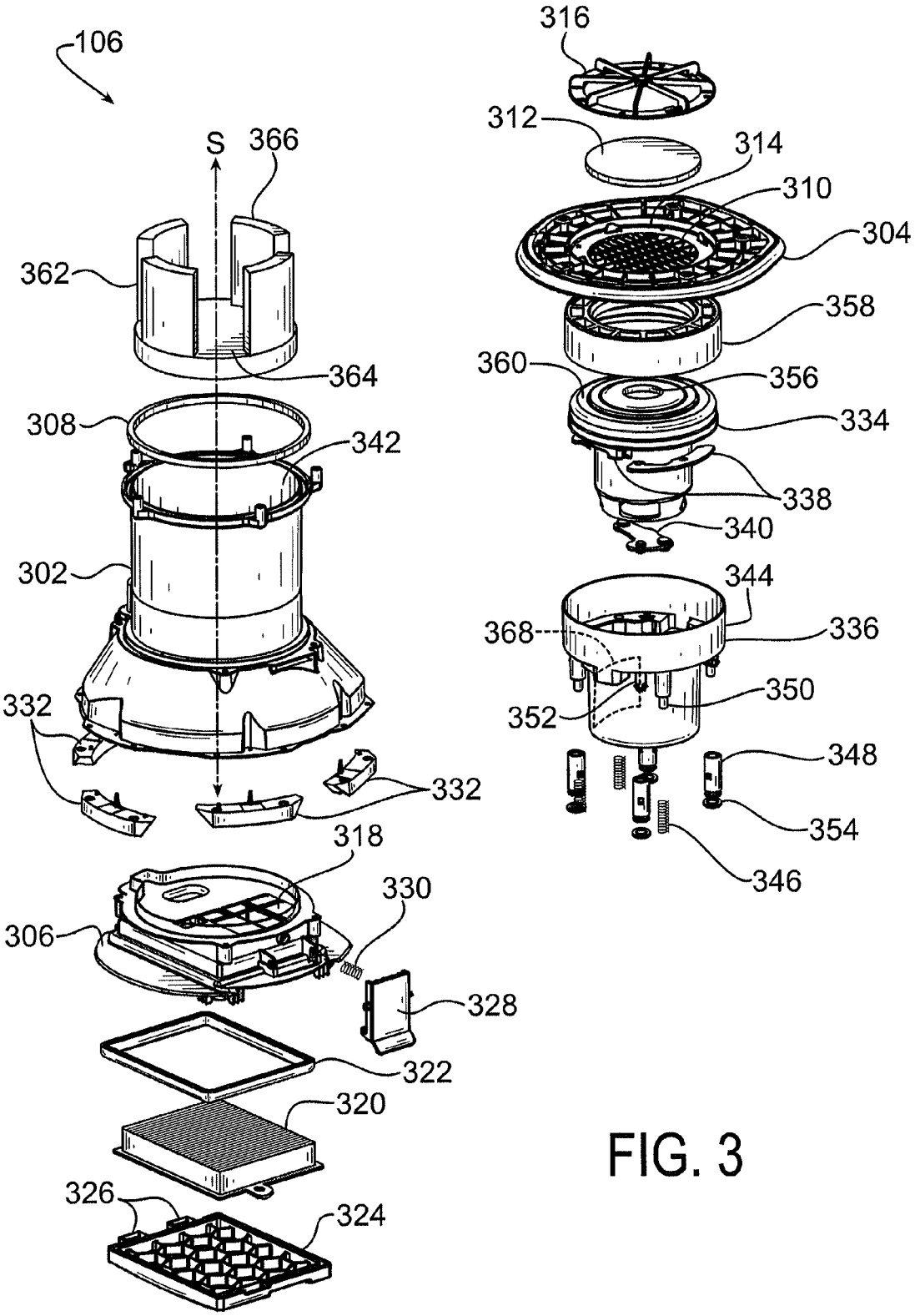
FIG. 3 is an exploded view of the motor module of the embodiment of FIG. 1.

Referring to FIGS. 1 and 2, an exemplary embodiment of a backpack vacuum module 100 is shown in assembled and exploded views. The backpack vacuum module 100 is provided as a generally hollow main housing 102 that forms an exterior shell of the module 100 and is covered on the top by a lid 104, and on the bottom by a motor module 106. The module 100 has an air inlet 108 that is connected to a flexible hose (not shown), as known in the art. An air outlet (318; FIG. 3) is located on the bottom of the motor module 106. Any operable variation on the shown construction may be used. For example, the air inlet 108 may be relocated from the lid 104 to a side of the main housing 102 or some other location, and the air outlet may be relocated as well. In addition, the main housing 102 may be open at the sides to provide a connection for a lid or other covers, rather than the top or bottom. These and other variations all are within the understanding of persons of ordinary skill in the art in view of the present disclosure.

The lid 104 of the exemplary embodiment may be connected to the open top of the main housing 102 by bayonet fittings 202, or other latches or securing mechanisms. The lid 104 covers a filtration chamber 204 located inside the main housing 102. The filtration chamber 204 may include any variety of filter, inertial separator, cyclone separator, or the like. Combinations of cyclones and/or filters also may be used. For example, the shown embodiment includes a two-layer filter comprising a reusable fabric bag filter 206 and a replaceable paper bag filter 208 that may be nested in the fabric bag filter 206. The bag filters 206, 208 each have a respective perimeter flange 210, 212 that may be secured by being clamped between the lid 104 and the main housing 102, but other connection mechanisms may be used. Such filter bags are conventional and need not be described any further here. It will be appreciated that the bag filtration system shown in the exemplary embodiment may be replaced with a cyclonic filtration system, such as shown in U.S. Pat. No. 5,267,371, which is incorporated herein by reference.

The motor module 106 may be secured to the bottom of the main housing 102 using screws, clamps or other connectors, and located generally inside the main housing 102, as shown. In alternative embodiments, the motor module 106 may be located partially or completely outside the main housing 102, or formed integrally with the main housing 102.

FIG. 3 shows the exemplary motor module 106 in exploded view. The motor module 106 comprises a generally hollow motor module housing 302 that is covered at the top by an upper cover 304 and at the bottom by a lower cover 306.

When the backpack module 100 is fully-assembled, the upper cover 304 may form the lower wall of the filtration chamber 204. A gasket, O-ring, or other seal (not shown) may be provided at the junction between the upper cover 304 and the main housing 102 to provide a leak-resistant barrier between the parts. Similarly, a gasket 308 or other seal may be provided between the upper cover 304 and the motor module housing 302 to form a leak-resistant barrier at this junction. A motor housing air inlet 310 is provided through the upper cover 304. In this case, the motor housing air inlet 310 is in the exemplary form of an integrally-formed grate providing multiple openings through the upper cover 304. The backpack module 100 may include a pre-motor filter 312, which may be retained in a recess 314 provided above the motor housing air inlet 310. A pre-motor filter holder 316 may be provided to hold the pre-motor filter 312 in place on the upper cover 304.

The lower cover 306 encloses the bottom of the motor module housing 302. A gasket, O-ring, or other seal (not shown) may be provided between these parts to provide a leak-resistant connection between these parts. The lower cover 306 may include a motor housing air outlet 318, which, in this exemplary embodiment, is an integrally-formed grate providing multiple openings through the lower cover 306. The lower cover 306 may be configured to hold a post-motor exhaust filter 320, which may be sealed to the lower cover 306 by an exhaust filter gasket 322 or other seal. The exhaust filter gasket 322 may be a separate part, or provided as part of the exhaust filter 320 or part of the lower cover 306. In the shown embodiment, the lower cover 306 includes an exhaust filter cover 324 that holds the exhaust filter 320 in place. The exhaust filter cover 324 may be connected to the lower cover 306 by any suitable mechanism. For example, one side of the exhaust filter cover 324 may have tabs 326 that fit into corresponding slots on the lower cover 306, and the other side of the exhaust filter cover 324 may be retained by a latch 328 that is pivotally mounted to the lower cover 306. A spring 330 may be provided to bias the latch 328 into the engaged position.

The motor module housing 302 also may include other features, such as one or more elastic bumpers 332 that are connected to the bottom end of the motor module housing 302. The bumpers 332 are expected provide some impact absorption capability.

Any suitable fasteners or connectors may be used to hold the foregoing parts of the motor module 106 together. Generally, conventional screws are suitable, but releasable fasteners, such as bayonet fittings or flexible tabs, may be used where ready access is desired. For example, the pre-motor filter holder 316 may be held to the upper cover 304 by flexible tabs to permit ready access to replace the pre-motor filter 312.

A suction motor 334 is located inside the motor module housing 302. The suction motor 334 may be any suitable electric motor, and may be powered by a cord, batteries, or a combination thereof. While the suction motor 334 may, in some embodiments, be mounted using conventional means and devices, in the shown exemplary embodiment, the suction motor 334 is mounted by a shock-absorbing suspension.

It is believed that a shock-absorbing suspension, such as the exemplary one described herein, can help mitigate certain problems associated with backpack vacuum cleaners. Suction motors typically comprise a relatively large proportion of the total mass of a backpack vacuum module. As such, the suction motor is responsible for generating a large amount of the stresses that arise when a backpack module is dropped. In the past, suction motors have been mounted to backpack modules by simple elastomeric or flexible mounts. Such mounts were used primarily to reduce the transmission of operating vibrations to the rest of the backpack module, which reduces the amplitude of the operating noise, and may reduce uncomfortable vibrations felt by the operator. However, such "vibration mounts" do not allow the motor to move any significant distance relative to the rest of the housing. In fact, relative movement between the suction motor and the housing would previously have been deemed undesirable because it would likely compromise the seal between the motor inlet and the suction air conduit, thereby interrupting or diminishing the suction power of the vacuum cleaner if the motor moved a significant distance relative to the housing.

Consequently, when a conventional backpack vacuum module is dropped on the ground, the typical vibration mounts do little or nothing to absorb the impact of the suction motor. Because typical vibration mounts allow virtually no relative movement between the suction motor and the housing, essentially the entire weight of the backpack module bears on the point of contact at the moment of contact. Similarly, a large proportion of the entire restoring force applied by the ground against the housing is transmitted immediately and directly to the suction motor, which can damage the housing. As a result of the foregoing, the typical backpack module is constructed to withstand impact of the entire module weight, which requires every stressed member between the impact point (typically the bottom of the module) and the suction motor, to be able to withstand the forces transmitted from the motor, through the housing, and to the ground. Such construction can add weight and complexity to the backpack module design. Further, even with a bulkier and stronger construction, there remains a concern that forces generated during impact can damage the housing, and that excessive abuse can ultimately fatigue even a reinforced housing.

To help mitigate damage caused by dropping the backpack module 100, the suction motor 334 may be mounted to the motor module housing 302 by a shock-absorbing suspension. The suspension is intended to absorb at least some of the shocks that might occur as the backpack module 100 is dropped on the ground, thereby potentially prolonging the service life of the housing and the suction motor.

Referring to FIGS. 3 and 4A-4C, the exemplary suspension comprises a suspension housing 336 to which the suction motor 334 is mounted. The suction motor 334 may be rigidly fastened to the suspension housing 336, but more preferably is mounted by vibration mounts such as upper and lower rubber mounts 338, 340. The vibration mounts operate as conventional vibration mounts to reduce the transfer of audible and tactile vibrations to the rest of the backpack module 100. The suspension housing 336 is shaped and sized to slide in a suspension direction (arrow S) within a corresponding suspension chamber 342 in the motor module housing 302. For example, the suspension housing 336 may have cylindrical outer wall 344 that moves within a correspondingly-shaped suspension chamber 342. In the shown embodiment, the cylindrical wall 344 does not touch the suspension chamber 342 walls, thus preventing friction between these surfaces.

The suspension housing 336 is mounted to the motor module housing 302 such that it can move, relative to the motor module housing 302, through a predetermined range of movement along the suspension direction S. The suspension housing 336 preferably is also mounted so that it cannot substantially move relative to the motor module housing 302 in any direction other that the suspension direction S.

In the exemplary embodiment, four springs 346 and four damper pistons 348 connect the suspension housing 336 to the motor module housing 302. It will be appreciated that, in other embodiments, different numbers of springs and dampers may be used, and the number of springs need not equal the number of dampers. For example, a single spring or single damper may be used, or a number of springs may be used with a lesser or greater number of dampers.

The springs 346 fit on respective first spring perches 350 that are distributed around the perimeter of the suspension housing 336. Similarly, the damper pistons 348 are mounted on corresponding damper mounts 352 distributed around the perimeter of the suspension housing 336. Any suitable connection between the spring 346 and damper pistons 348 and their respective perches 350 and mounts 352 may be used. For example, In the illustrated embodiment, the springs 346 are captured in place, and the damper pistons 348 slide over the hollow damper mounts 352 and connect to them by snap fittings.

Figure 4A:
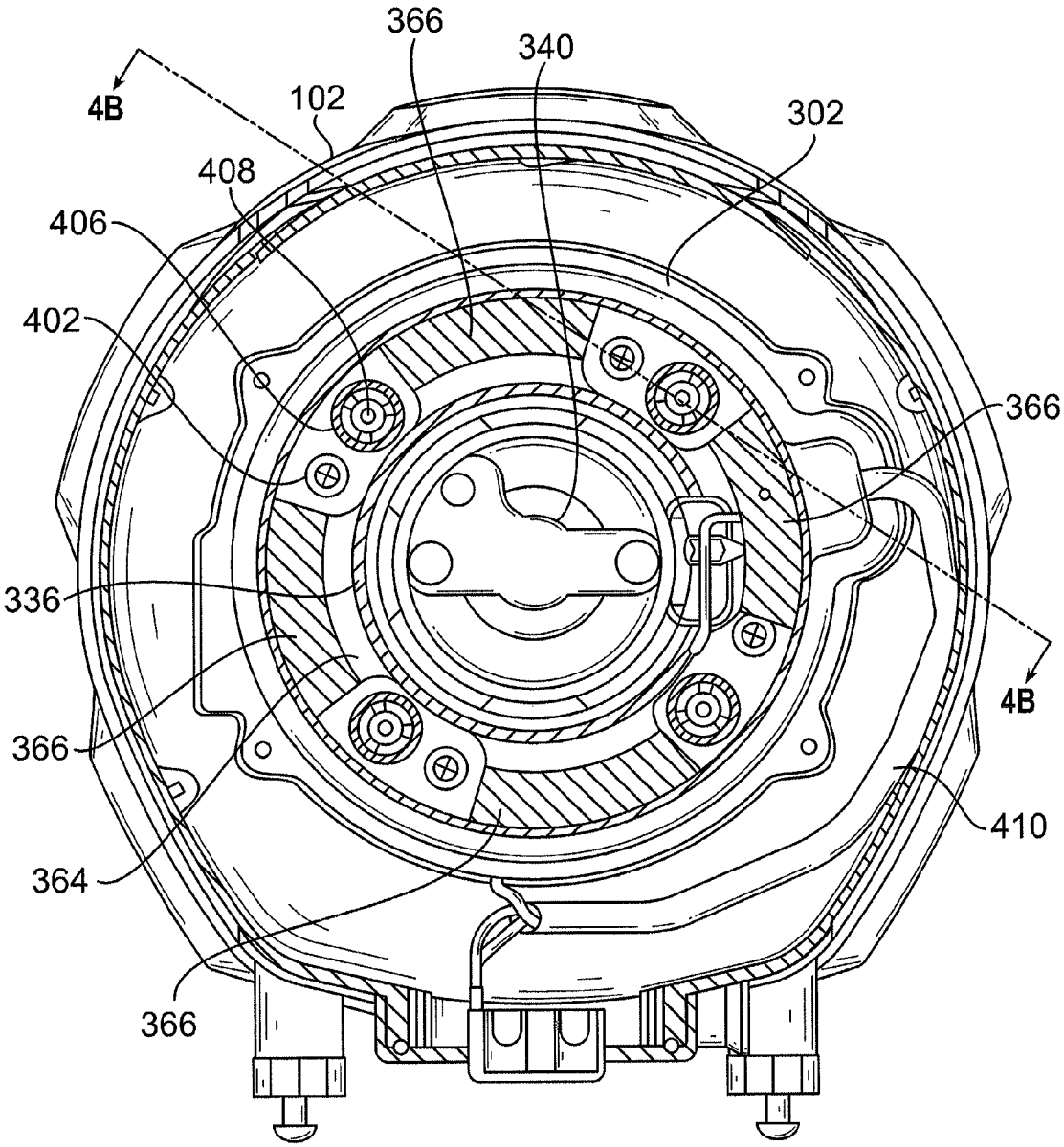
FIG. 4A is a cutaway top view of the motor module of FIG. 3.
Figure 4B:
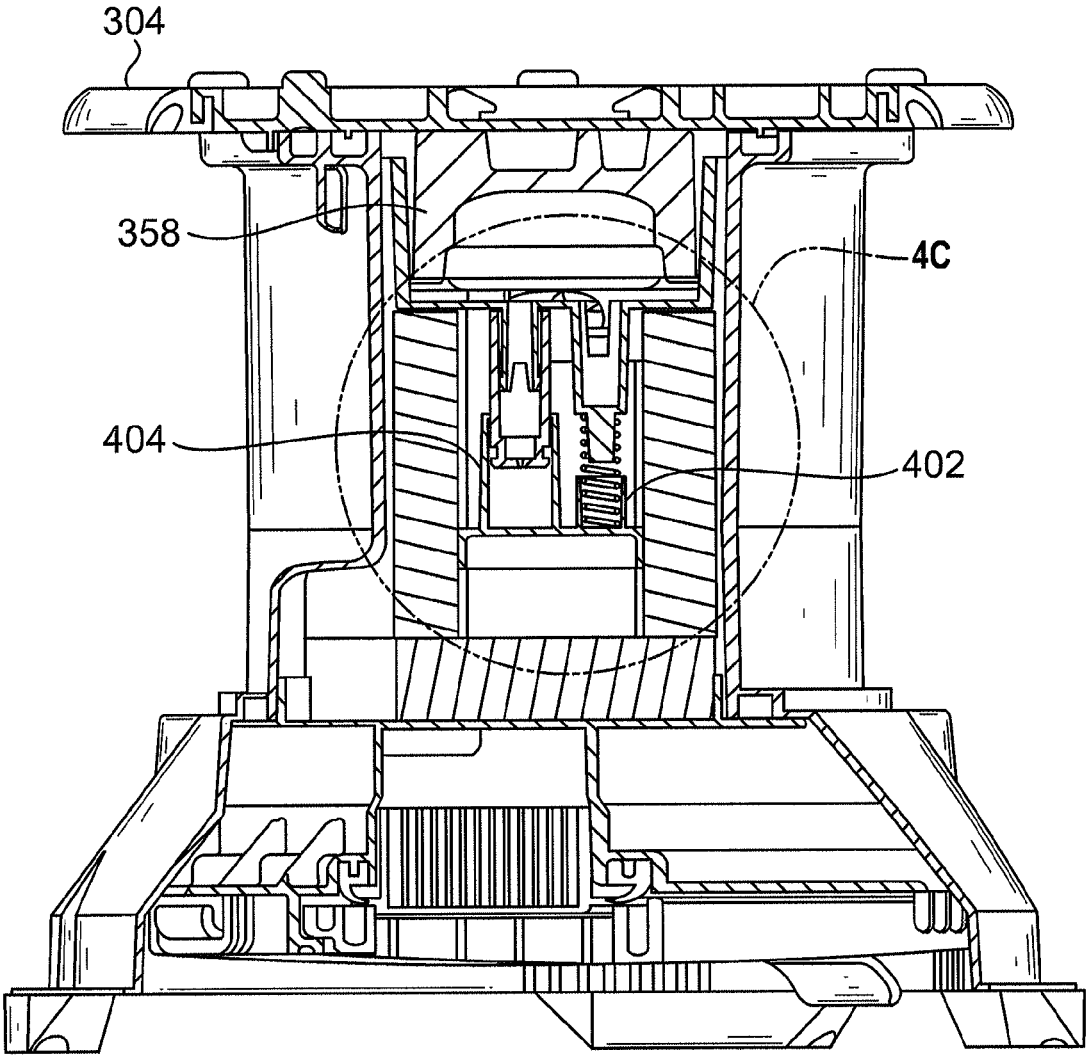
FIG. 4B is a cutaway view of the motor module of FIG. 3, shown along line 4B-4B of FIG. 4A.
Figure 4C:
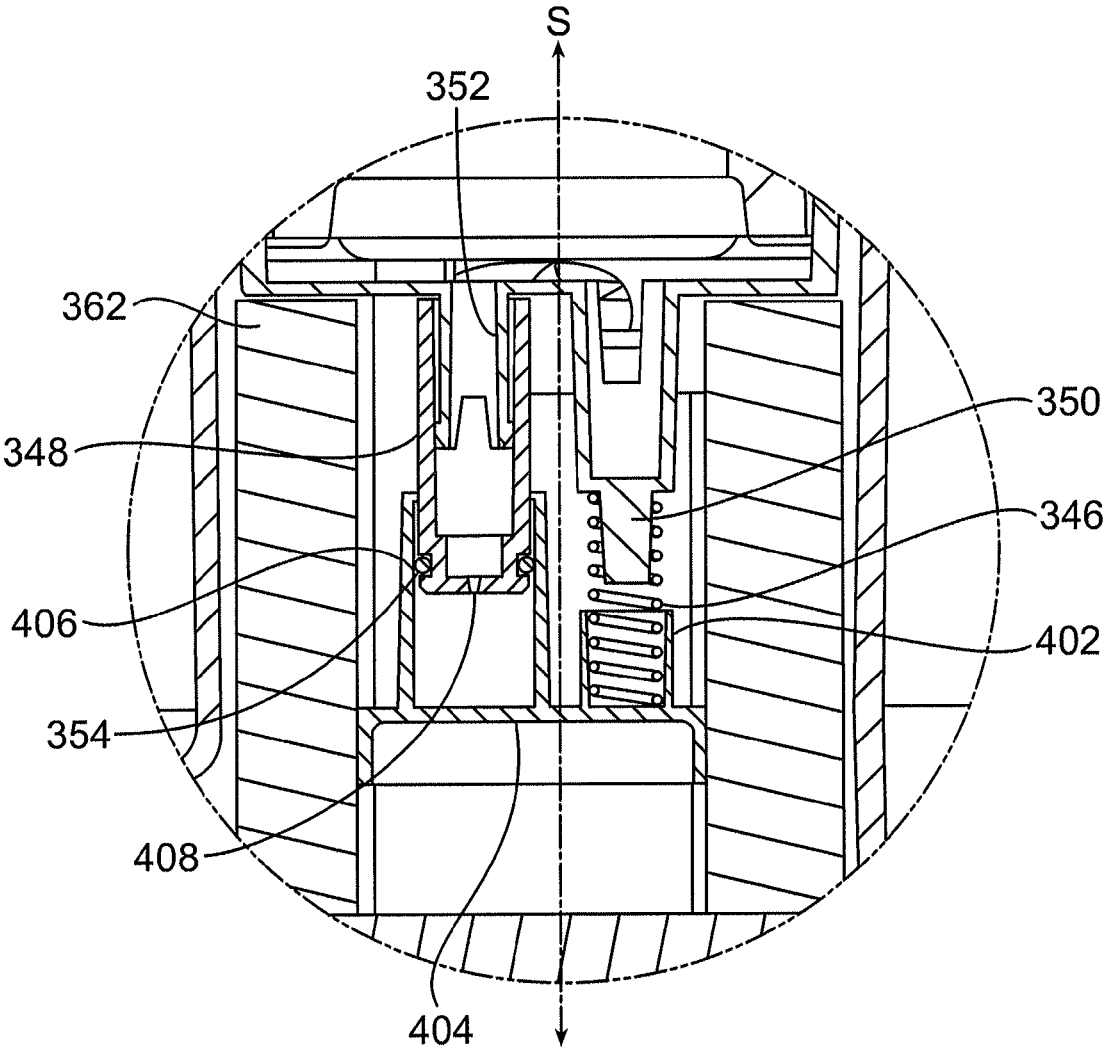
FIG. 4C is a cutaway view of the portion of FIG. 4B within circle 4C.

Referring to FIGS. 4B and 4C, the springs 346 are also mounted to respective second spring perches 402 located inside the motor module housing 302. Thus, each spring 346 is connected at a first end to the suspension housing 336, and at a second end to the motor module housing 302. The springs 346 form a spring-mounted coupling between the motor module housing 302 and suspension housing 336, in which the amount of relative movement between the motor module housing 302 and suspension housing 336 is generally proportional to the force applied to provide the relative movement. While the operative connection between the springs 346 and the motor module and suspension housings 302, 336 is illustrated as a direct connection with no intervening parts, it will be appreciated that other operative connections may have elements interposed between the parts.

In this embodiment, the first spring perches 350 comprise internal supports that are located inside the spring, and the second spring perches 402 comprise external supports that surround the spring, but alternative arrangements may be used. The second spring perches 402 may be mounted on a shelf 404 inside the suspension chamber 342. The shelf 404 may comprise a continuous support structure that holds all of the second spring perches 402, or it may be divided into multiple support structures. In the exemplary illustrated embodiment, each second spring perch 402 is mounted on a respective shelf 404 that protrudes radially inwardly from the inner wall of the motor module housing 302.

Still referring to FIGS. 4B and 4C, each damper piston 348 fits inside a respective damper cylinder 406 located inside the motor module housing 302. Each damper piston 348 may have an O-ring 354 or other seal that provides a partial or complete air seal between the outer surface of the damper piston 348 and the inner surface of the damper cylinder 406. The O-ring 354, damper piston 348 and/or damper cylinder 406 may be lubricated and/or made of low-friction material to facilitate smooth relative motion between the damper piston 348 and damper cylinder 406. If desired, the O-ring 354 may be replaced by a lip seal or other seal retained on the damper cylinder. The damper piston 348 and/or damper cylinder 406 may include one or more orifices 408 to form a damper system (discussed below), but the orifice 408 may be omitted to convert these parts into an air spring. As with the springs, the damper elements 348/406 may be operatively connected between the motor module housing 302 and suspension housing 336 by direct connection to the housings, or with one or more interposed parts.

When assembled, the damper piston 348 and damper cylinder 406 together form a functional damper. Relative motion between the damper piston 348 and damper cylinder 406 forces air through the orifice 408. This movement of the air is facilitated by making the damper mounts 352 hollow, as shown in FIG. 4C. The viscous motion of the air through the orifice 408 generates a resistance force that is proportional to the velocity of the relative movement, thereby generating a damping force to resist such relative movement.

Together, the springs 346 and dampers (i.e., the damper piston 348/damper cylinder 406 assemblies) suspend the suspension housing 336 and suction motor 334 within the motor module housing 302. This form of suspension can be referred to as a damped spring-mass system. The springs 346 generally regulate the magnitude of relative movement between the two housings, and the dampers control oscillations that might occur as the springs rebound after being compressed. The precise properties of the damped spring-mass system can be modified by selecting the spring constant (a function of conventional spring design) and damping properties (which, in this case, are largely a function of friction between the piston and cylinder and the orifice size). Depending on these properties, the system may be under-damped, critically damped, or over-damped. The selection of the relevant properties of damped spring-mass systems, and the correlating mathematical formulae, are well-known in the mechanical arts, and need not be discussed in further detail herein. It is preferred, but not required, for the system to be critically damped, meaning it returns to the rest condition as quickly as possible without oscillating. In this embodiment, the dampers are tuned to the resonant frequency of the spring and suspended mass system to prevent unwanted oscillations.

It will be appreciated that different kinds of springs or dampers may be used to replace or supplement the illustrated exemplary embodiments. For example, the springs 346, which are shown as metal coil springs that are operated in compression, may be replaced with leaf springs, torsion arms, air springs (flexible bladders or pressurized air), elastomeric blocks, or any other kind of significantly compressible or collapsible structure that permits tangible motion in one direction, and applies a biasing force in the opposite direction. Such springs may be operated in compression or tension. As another example, the dampers may be replaced by elastomeric blocks (which may double as springs), liquid viscous couplings (instead of the shown air viscous coupling), sliding friction surfaces, or the like. Furthermore, the locations of various mounts may be modified or reversed. It is also noted that the damper pistons 348 may be integrally-formed as part of the suspension housing 336 or motor module housing 302, or they may be provided as separate attached parts (as shown), which may provide the opportunity to more precisely machine the damper pistons 348 to regulate their damping properties.

The springs 346 and/or damper elements 348/406 may be located generally equidistantly, in a direction perpendicular to the suspension direction S, from the center of gravity of the moving assembly (e.g., the suction motor 334, suspension housing 336, and so on) or portions thereof (e.g., only the suction motor 334). In addition, the springs 346 and/or damper elements 348/406 may be located generally at equiangular locations, in a plane perpendicular to the suspension direction S, from the center of gravity of the moving assembly or portions thereof. For example, the springs 346 may be about 90 degrees apart from one another, as viewed along the suspension direction S. The springs 346 and/or damper elements 348/406 also may be located at a point along the suspension direction S where they generally surround the center of gravity of the moving assembly or portions thereof.

The locations of the springs 346 and damper elements 348/406 in this exemplary embodiment are selected to provide evenly distributed support, generally resist torsional moments that might impede the operation of the suspension, and resist forces perpendicular to the suspension direction S. It will be understood, however, that the foregoing locations are not strictly required. In other embodiments, the springs 346 and damper elements 348/406 may be located in different locations and distributed at different intervals around the suspension housing 336. For example, the springs 346 may be mounted at the bottom end of the suspension housing 336, rather than being mounted at a location between the ends of the suspension housing 336, and the damper elements 348/406 may be located where they are shown, or at other locations.

As shown in FIG. 4C, the springs 346, damper pistons 348 and damper cylinders 406 are oriented parallel to the suspension direction S in order to regulate the motion of the suspension housing 336 in this direction. The suspension direction S is the direction in which the suspension housing 336 is able to slide relative to the motor module housing 302. The suspension direction S may be oriented at any desired angle with respect to the backpack module 100. The sliding movement of the parts may be controlled by providing bearing surfaces that allow movement along the suspension direction S, but restrict movement perpendicular to the suspension direction S. In the shown embodiment, the damper pistons 348 and damper cylinders 406 (along with the O-rings 354) provide bearing surfaces that dictate the suspension direction S that restrict movement in any direction but the suspension direction S. If desired, additional or alternative bearing surfaces may be provided to establish the suspension direction S, which may be necessary if the dampers are not used as bearing surfaces. For example, the suspension housing 336 may have ribs that fit into corresponding slots on the motor module housing to provide sliding bearing surfaces, or the cylindrical wall 344 surrounding the suspension housing 336 may act as a bearing surface. As another example, posts on the suspension housing 336 may slide along linear bearings or bushings on the motor module housing 302. Other variations will be apparent to persons of ordinary skill in the art in view of the present disclosure.

In use, the suspension system allows the suction motor 334 to move up to a predetermined distance in a controlled manner to absorb at least a portion of the impact forces that are generated when the backpack module 100 is dropped on the ground. When an object is dropped and strikes the ground, an impact force is generated at the point of contact. The impact force generally is absorbed by the structure surrounding the impact location, and the impact force is applied throughout the duration of the impact. In conventional equations, the impact force is often represented by the equation $F=\frac{1}{2}(mv^2)/s$, where "F" is the impact force, "m" is the mass, "v" is the velocity at impact, and "s" is the stopping distance. Thus, the magnitude of the impact force is proportional to the mass of the object, and inversely proportional to the distance the object travels before it stops.

In conventional backpack vacuum modules, the entire module will stop essentially immediately upon striking the ground. In this system, the mass is the entire mass of the backpack module, and the stopping distance is very short, leading to a relatively high impact force.

In contrast, a suspension system, such as the exemplary embodiments described herein, is expected to mitigate the impact force. In this system, the mass of the suction motor stops over a relatively large distance (the suspension travel distance), while the remaining mass of the module stops essentially immediately upon striking the ground. The relative movement between the suction motor and the rest of the module mitigates the impact force by increasing the stopping distance of the suction motor and effectively reduces the mass of the portion of the module that stops immediately upon contact with the ground. Since the mass of the suction motor typically is a large proportion of the total mass of the backpack module, the mitigating effect of the suspension system can be significant.

The amount of impact force that is mitigated by the suspension will also depend on the orientation of the suspension direction S with respect to the impact direction. If the impact direction and suspension direction S are parallel, then the full impact force will be transmitted through the suspension. As the suspension direction S diverges from the impact direction, the amount of impact force transmitted to the suspension will decrease, in keeping with the well-known force vector equations.

In the exemplary embodiment, the suspension direction S is oriented generally along the vertical axis of backpack module 100. The vertical axis is the up-down gravitational direction when the backpack module 100 is worn by an operator. This orientation is selected for this embodiment because it is believed that backpack modules are most commonly dropped on the bottom end of the module. In fact, in many backpack vacuum modules the suction motor is very close to the bottom of the module, and thus it is likely that the large majority of impacts occur with the module oriented generally vertically. Thus, the suspension direction S is expected to be oriented at least partially along the direction of most impacts.

It will be appreciated that the suspension direction S may be oriented in different directions in other embodiments. For example, if it is found that backpack vacuum modules of a particular kind are typically dropped on their back, then the suspension direction S may be oriented so that the suspension is operative when the module is dropped on its back. As another example, backpack vacuums that are worn around the waist by a belt might be dropped while the operator is holding one end of the belt with the vacuum cleaner perpendicular to its normal orientation on the operator's waist—in this case, the suspension direction S might be horizontal when the module on being worn by the operator, and vertical when the module is removed from the user's body in a typical fashion to align with the most likely direction of impact.

In the exemplary embodiment, the suspension direction S is also oriented along the rotational axis of the suction motor 334. As shown in FIG. 3, the suction motor 334 may be oriented vertically so that the motor and fan rotate about the vertical axis. The suction motor inlet 356 faces the motor housing air inlet 310, and may be surrounded by a motor gasket 358 that seals the top of the suction motor 334 to the motor housing air inlet 310. In the shown embodiment, the motor gasket 358 may be connected either to the bottom of the upper cover 304 or to the suction motor 334/suspension housing 336 assembly. For example, the motor gasket 358 may be pinched between the outer perimeter of the suction motor fan shroud 360 and the inner wall of the suspension housing's cylindrical outer wall 344, such as shown in FIG. 4B.

During normal operation, the motor gasket 358 contacts the bottom of the upper cover 304 and surrounds the motor housing air inlet 310, to thereby create a generally leak-resistant suction air path to the suction motor inlet 356. During an impact, the moving assembly (suction motor 334/suspension housing 336/motor gasket 358) may move far enough that the motor gasket 358 separates from the upper cover 304 momentarily until the springs 346 rebound. Since impacts would normally occur after the vacuum cleaner has been turned off in preparation for removal from the operator's body, the momentary loss of a sealed path between the motor housing air inlet 310 and suction motor inlet 356 would have no operational consequence. However, even if the suction motor 334 is operating during an impact, the momentary loss of a sealed path is not expected to negatively affect the operation or durability of the vacuum cleaner.

In the shown embodiment, the suction motor 334, suspension housing 336, and motor gasket 358 are all mounted on the suspension, thereby potentially mitigating the amount of impact force attributable to the mass of these parts. Further impact attenuation may be provided by mounting other parts on the suspension or on their own suspension systems. For example, where the backpack module 100 is battery-operated, it may be particularly beneficial to mount the batteries (which typically are relatively heavy) on the suspension with the suction motor 334.

In the exemplary embodiment, the maximum travel distance of the suction motor 334 is about 0.5 inches. The total travel may be controlled by bump stops or selecting the springs 346 to prohibit further movement. In this embodiment, the system may be tuned to account for drops as high as those that would be expected by typical operators. For example, the system may be tuned to account for drops by operators having a height in the 95th percentile of users, plus an extra margin of 30%. In other embodiments, lesser or greater travel distances may be selected to absorb impact forces to help prolong the lifespan of the vacuum module 100. Furthermore, where an appreciable quantity of impact force is absorbed, the structure of the remainder of the backpack module 100 may be modified to account for the fact that it no longer needs to absorb relatively high impact loads. Thus, it may be possible to make the backpack module 100 lighter and hence less fatiguing to carry.

While it is expected that a momentary loss of a sealed suction path during an impact will not cause any substantial operating issues, it is preferable to ensure that the sealed suction path is substantially restored after each impact to ensure proper operation of the vacuum system after the impact. In the shown embodiment, the sealed suction path may be restored by the suction motor 334 itself, as the generated suction creates a partial vacuum in the space above the suction motor 334 to pull the assembly back to its starting position. The ability to restore the seal may be compromised if the moving parts become fouled with dust and debris, which may be more likely to happen after the device has been in service for a long time. As such, it may be desirable to take measures to ensure smooth operation of the suspension. The use of high-durability parts, lubricants or low-friction materials, and precise tolerances may help ensure continued smooth operation. The suction motor 334 itself may be used to help remove debris from working parts, such as by locating suction taps around the moving parts. In the shown embodiment, the suspension parts are kept relatively clean by locating them on the exhaust side of the suction motor 334, where the airflow is relatively free of dirt and debris.

The location of the springs 346 and damper elements 348/406 can also influence the durability of the system. For example, the exemplary embodiment places the springs and damper elements 348/406 around the center of gravity of one or more of the moving parts (e.g., the suction motor 334, suspension housing 336 and motor gasket 358) where they are relatively resistant to torsional moments that might tend to misalign and wear the moving parts. Regular service may also be desirable, in which case simple serviceability is preferred. In the shown embodiment, access to clean the suspension parts is readily obtained by removing screws or clamps that hold the motor module housing 302 to the main housing 102, and then removing screws that hold the upper cover 304 to top of the motor module housing.

Another way to help ensure that the sealed suction path is restored after an impact is to use springs with a relatively high spring constant, which will provide a greater restoring force (at the cost of increasing the impact force). Still another way to help restore the sealed suction path is to preload the springs so that they are slightly compressed even when the system is at rest, which ensures a restoring force is always applied to move the motor gasket 358 into place. Also, embodiments may use a pliable motor gasket 358 that is somewhat deformed as it is pressed against the upper cover 304 during rest. Such a motor gasket 358 will expand and remain in contact with the upper cover 304 during smaller impacts, and can restore the seal even if the suspension assembly does not return all the way to its original position after an impact. Still another approach would be to provide a sealed suction path that does not unseal during impacts, such as by using a flexible bellows, or a sliding sealed passage as explained below with reference to FIG. 5.

The motor gasket 358 may double as a shock absorber that prevents the moving assembly from striking non-moving elements upon recovering from an impact. If desired, supplemental travel stops (not shown) may be provided to limit the return travel of the moving assembly.

Figure 5:
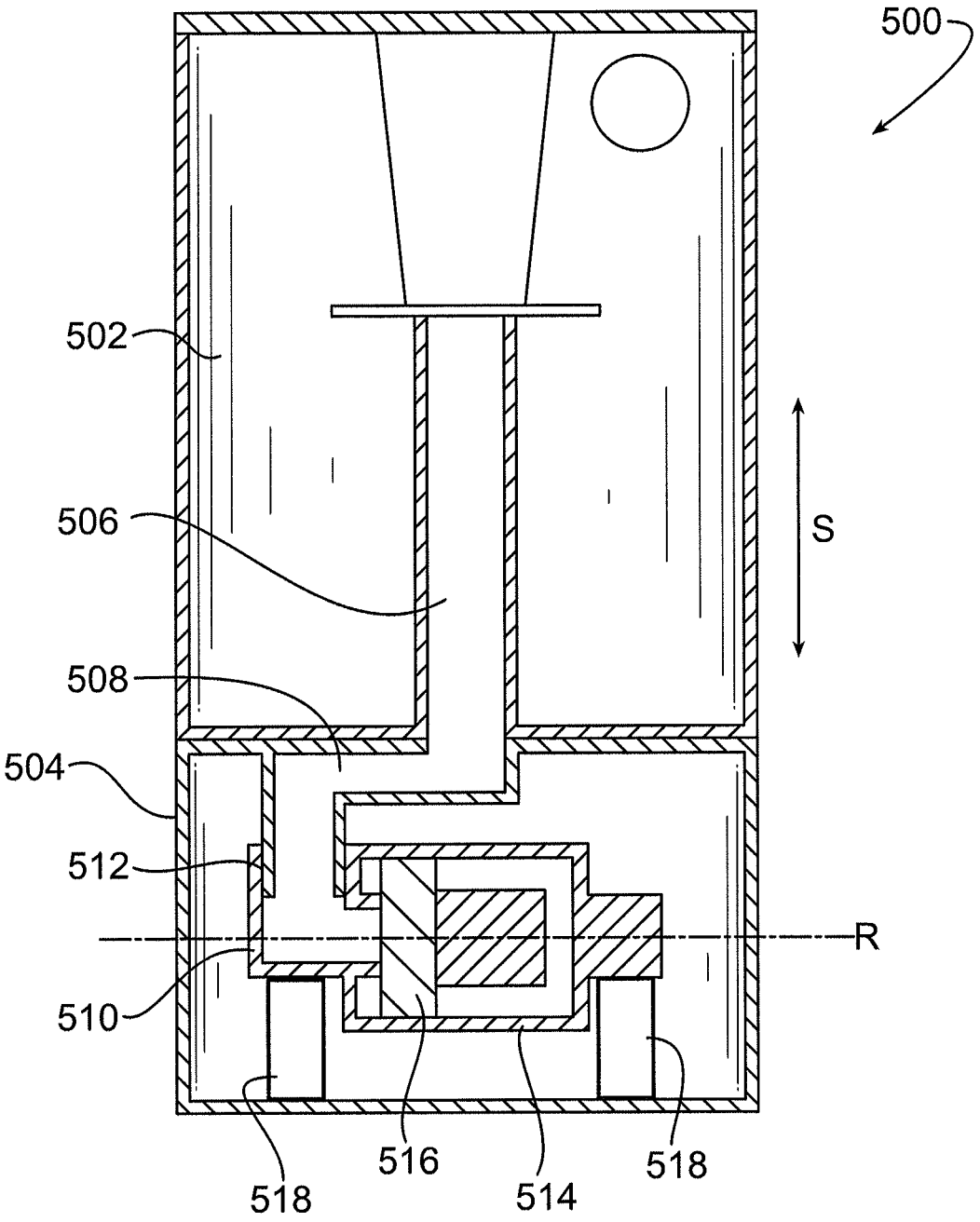
FIG. 5 is a side cutaway view of another embodiment of a backpack vacuum module.

FIG. 5 illustrates and alternative embodiment in which the suspension direction S' is not parallel with the suction motor's rotation axis R. Here, the backpack module 500 comprises a cyclone separator 502 that is mounted on a motor housing 504. An air outlet 506 leaving the cyclone separator 502 connects to a first air passage 508 inside the motor housing 504. The first air passage 508 is telescopically mated to a second air passage 510 with a sliding seal 512 provided between the first and second air passages 508, 510. The sliding seal 512 may comprise one or more O-rings, lip seals, wiping seals, or the like. The second air passage 510 is connected to a suspension housing 514 and provides a fluid path to the inlet of a suction motor 516 located inside the suspension housing 514. Thus, the first and second air passages 508, 510 form a sealed, telescopically sliding suction passage from the cyclone separator 502 to the suction motor 516. It will be appreciated that the telescoping tubes may be replace with a suitable telescoping bellows that flexes to maintain a continuous suction passage. Such a bellows should be selected to resist the suction forces generated by the suction motor 516 during typical operation to prevent unwanted collapse of the bellows. In the embodiment of FIG. 5, the suspension housing 514 is movably mounted to the motor housing 504 by one or more spring and damper assemblies 518, which may be like those described with reference to the earlier Figures or of different constructions.

Of course, other arrangements and orientations of the suspension system may be used in other embodiments, and such variations will be within the understanding of persons of ordinary skill in the art in view of the present disclosure. It will also be appreciated that the foregoing embodiments may be altered or supplemented in various ways. For example, the suspension system may be a double-acting suspension that absorbs impacts in two opposite directions. In addition, the suspension may be modified to permit and control movement in additional directions to absorb impacts at multiple different angles.

In other embodiments, the dampers may be removed to provide a simple spring-mass suspension system. For example, the damper elements 348/406 may be omitted. In this example, contact between the motor gasket 358 and the upper cover 304 may absorb impacts caused as the springs 346 rebound after an impact. If a simple spring-mass system is used, care should be taken to avoid resonant frequencies generated during use (e.g., by the motor) from activating the system and causing unwanted oscillations. In still other embodiments, the springs and dampers may be consolidated into unitary parts. For example, the springs and dampers may be provided as coil springs that surround respective dampers, or the separate springs and dampers may be replaced by materials having spring-like properties and damper-like properties, such as elastomeric foams.

It will also be appreciated that alternative embodiments also may be modified by removing or consolidating parts. For example, the suspension housing 336 may be omitted by connecting the springs 346 and damper pistons 348 directly to the suction motor 334. The suspension housing 336 also may be a simple frame that connects the springs 346 and damper pistons 348 to the suction motor 334, but does not enclose the suction motor 334. As another example, the upper or lower cover 304, 306 may be integrally-formed with the motor module housing 302.

It will further be appreciated that the suspension may be provided between different housing members. For example, the entire motor module 106 may be suspended within the main housing 102.

Other variations and modifications of suspension systems will be apparent in view of the present disclosure and with routine practice of the invention.

Figure 6:
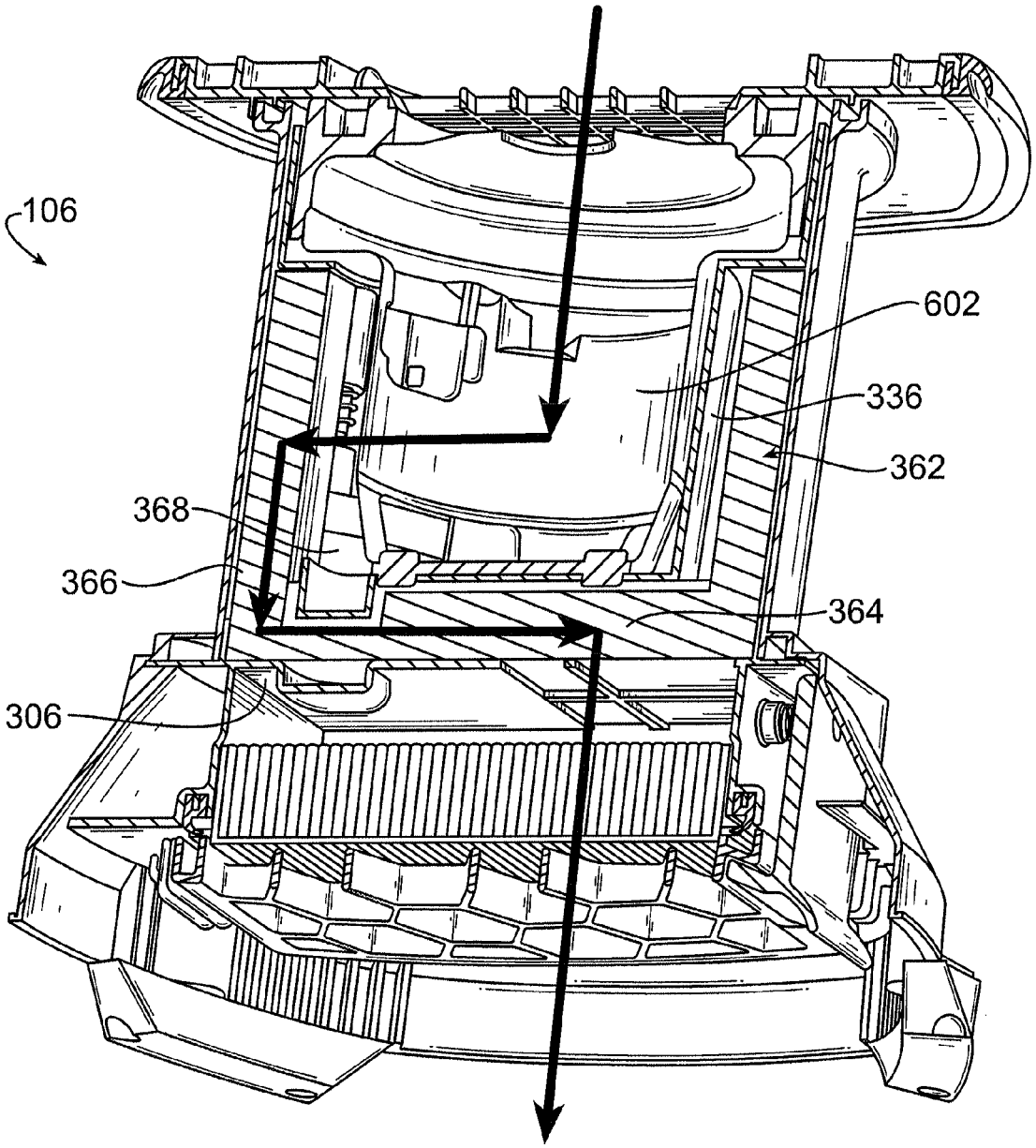
FIG. 6 is cutaway isometric view of the motor module of FIG. 3.

Referring now to FIGS. 3 and 6, one or more sound-absorbing inserts 362 may be provided in the motor module housing 302 to reduce the amplitude of noise generated by the suction motor 334. The exemplary sound-absorbing insert 362 may comprise a sound absorbing material, such as a high loft polyester ("HLPE") foam or other suitable material. The illustrated sound-absorbing insert 362 comprises a base 364 and a number of walls 366 that extend upward from the base 364. The insert 362 is located in a space formed between the motor module housing 302 and the suspension housing 336. As shown in FIG. 6, the base portion 364 is located below the suspension housing 336, and the walls 366 extend upwards to surround at least portions of the suspension housing 336.

As best shown in FIG. 4A, in the exemplary embodiment, the springs 346 and damper elements 348/406 may be arranged radially around the suspension housing 336, and the walls 366 may be arranged radially around the suspension housing 336 in gaps between adjacent springs 346 and/or damper elements 348/406. This arrangement provides a particularly compact assembly for the suspension and sound-absorbing elements of the device, but other arrangements may be used in other embodiments. FIG. 4A also shows a power cord 410 that connects an exterior cord (not shown) to the motor module housing 302. The power cord 410 continues to the suspension housing 336, and then to the suction motor 334, which is not shown in FIG. 4A. The power cord 410 may include a predetermined amount of slack to join to the suction motor 334 without pulling out or stretching as the suction motor 334 moves.

The sound-absorbing insert 362 helps reduce suction motor noise, and may reduce noise multiple ways. For example, the base 364 and walls 366 may at least partially isolate the suction motor 334 from the surrounding components, thereby reducing the transmission of noise to the surrounding components. The sound-absorbing insert 362 may be located in the airflow path between the suction motor exhaust and the motor housing air outlet 318 to diffuse the exhaust airflow leaving the suction motor 334, which may reduce whistling and other noises associated with concentrated airflows passing through internal passages. In addition, the HLPE material absorbs high-frequency sounds that are caused by the suction motor vanes passing by fixed objects in the motor or other phenomena.

A further sound-reducing benefit may be obtained by providing a convoluted exhaust airflow path from the suction motor 334 to the motor housing air outlet 318. As shown in FIG. 6, the airflow path (shown schematically by arrows) enters the motor module 106 through the motor housing air inlet 310. The incoming airflow enters and passes through the suction motor 334, which is contained in the suspension housing 336. (For clarity, only the outer shell 602 of the suction motor 334 is illustrated in FIG. 6.) The portion of the suspension housing 336 surrounding the exhaust side of the suction motor 334 is formed as a cup-like enclosure having an opening 368 (or multiple openings) on one side. The exhaust airflow passes through the opening 368 and into the space between the suspension housing 336 and the suspension chamber 342. Here, the exhaust airflow enters the walls 366 of the sound-absorbing insert 362 where it begins to diffuse. The exhaust airflow is expected to wrap entirely around the suspension housing 336 and eventually move into the base 364 of the sound-absorbing insert 362, which is located in the space between the suspension housing 336 and the lower cover 306. The exhaust airflow then progresses to the motor housing air outlet 318. The motor housing air outlet 318 preferably is located on the opposite side of the motor module housing 302 as the opening 368 through the suspension housing 336, so that the opening 368 faces away from the motor housing air outlet 318. As shown by the arrows in FIG. 6, this arrangement provides a convoluted path from the suction motor 334 to the motor housing air outlet 318, and increases the distance that the exhaust airflow travels through the sound-absorbing insert 362. Furthermore, this sound-reducing arrangement is lightweight and does not appreciably increase the weight of the backpack module 100.

It will be appreciated that the suction motor 334 alternatively may be contained in a simple motor housing if no suspension is used or the suspension is located elsewhere. Also, to provide a free space for movement of the suspension housing 336, the base 364 may not occupy the entire height of the space between the suspension housing 336 and the lower cover 306. In this case, the exhaust airflow may pass through the gap between the base 364 and the suspension housing 336 before entering the base 364 to travel to the motor housing air outlet 318. If the base 364 does occupy this entire space, then it may be made of a compressible material that permits movement of the suspension housing 336 during an impact.

It will be appreciated that the sound-absorbing insert 362 may be provided in other locations in other embodiments. The sound absorbing insert 362 also may be provided as separate parts (e.g., separate walls and a base), and portions of the sound absorbing insert 362 may be omitted (e.g., a base, but not walls). The sound-reducing insert 362 also may be made of a non-porous material, if the airflow does not need to pass through it to get to the motor housing air outlet 318. It will also be appreciated that the insert 362 and other noise-reducing features described herein may be used in embodiments that do not have a suspension system.

Figure 7:
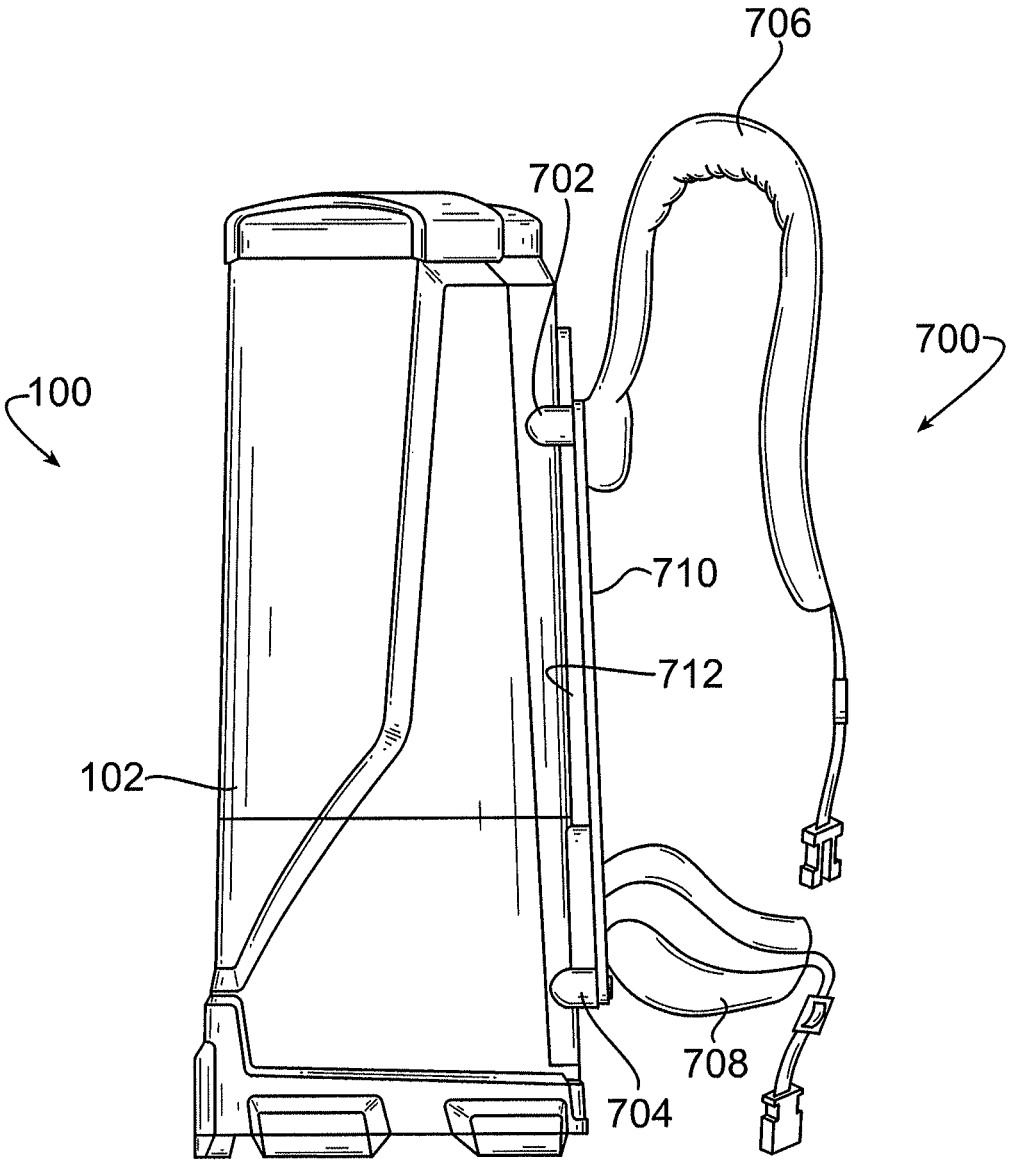
FIG. 7 is side view of the embodiment of FIG. 1, illustrated with a harness attached to the backpack vacuum module.

Referring now to FIG. 7, it will be appreciated that any suitable harness or other system may be used to connect the backpack module 100 to an operator's body. In the exemplary embodiment, a harness 700 is attached to the front of the backpack module 100 at upper mounts 702 and lower mounts 704. The upper mounts 702 and lower mounts 704 each may comprise any number of connectors, such as nuts, bolts or screws, that are generally grouped together to form a structural connection between the harness 700 and the backpack module 100. The upper mounts 702 are vertically spaced from the lower mounts 704 to distribute the forces transmitted between the harness 700 and the backpack module 100. The harness 700 may include shoulder straps 706, a waist belt 708, and a back support 710 that joins the shoulder straps 706 to the waist belt 708.

The shoulder straps 706 are configured to pass over an operator's shoulders, and the waist belt 708 is configured to wrap around the operator's waist. Suitable clasps, buckles, or the like are provided to hold the waist belt 708 and shoulder straps 706 together, and adjustment mechanisms may be provided to allow operators to customize the dimensions of the waist belt 708 and shoulder straps 706.

The back support 710 rests against the operator's back, and may be contoured in one or more dimensions to provide an ergonomic fit. The back support also may include padding, adjustable bolsters, or other comfort or fit enhancing features. The back support 710 preferably comprises a relatively rigid structure, such as a plastic or metal panel or strap, that is spaced from the main housing 102 of the backpack module 100 by a gap 712. The gap 712 may extending generally all the way from the upper mounts 702 to the lower mounts 704, but there may be intermediate connections between the back support 710 and the main housing 102. It is believed that providing such a gap 712 will further enhance the comfort of the harness 700 by helping to isolate the operator from the backpack module 100. For example, the gap 712 may reduce the magnitude of heat and vibrations that are transmitted to the operator's body. The gap 712 also may be used in conjunction with a relatively narrow or vented back support 710 to improve breathability along the operator's back, thereby keeping the operator cooler when the backpack module 100 is mounted.

The foregoing exemplary embodiment may be modified or supplemented, such as by adding a power switch to the strap as known in the art. Furthermore, the foregoing exemplary embodiment of a harness 700 may be used with or without other features described herein (e.g., sound-reducing features or suspension features). Such modifications will be apparent to persons of ordinary skill in the art in view of the present disclosure.

It should be noted that terms such as "upper" and "lower" are used herein to assist with describing the illustrated embodiments and to indicate relative position within the frame of reference of the embodiment itself. Except as where otherwise stated, the frame of reference of the embodiment is arbitrary in relation to the gravitational reference frame, and these terms of relative position are not intended to limit the invention to positions in the gravitational reference frame. For example, a part described as an "upper" part, may be at the same level or below a "lower" part as examined in the gravitational reference frame.

The present disclosure describes a number of new, useful and nonobvious features and/or combinations of features that may be used alone or together. The embodiments described herein are all exemplary, and are not intended to limit the scope of the inventions. It will be appreciated that the inventions described herein can be modified and adapted in various and equivalent ways, and all such modifications and adaptations are intended to be included in the scope of this disclosure and the appended claims.

The invention claimed is:

1. A backpack vacuum cleaner motor mounting assembly comprising:

a first housing having an air inlet, an air outlet, and a suspension chamber located inside the first housing;

a suspension housing at least partially contained within the suspension chamber, the suspension housing being configured to slide through a predetermined range of movement during an impact, relative to the suspension chamber, along a suspension direction from a first position to a second position, and the suspension housing being substantially restricted from moving, relative to the suspension chamber, perpendicular to the suspension direction;

a suction motor connected to and movable with the suspension housing, the suction motor having a suction motor inlet in fluid communication with the air inlet, and a suction motor outlet in fluid communication with the air outlet; and one or more springs operatively positioned between the first housing and the suspension housing, the one or more springs being oriented to bias the suspension housing from the second position towards the first position;

wherein the suction motor has a rotation axis, the rotation axis being generally parallel with the suspension direction.

2. The backpack vacuum cleaner motor mounting assembly of claim 1, wherein the suction motor is connected to the suspension housing by one or more vibration mounts.

3. The backpack vacuum cleaner motor mounting assembly of claim 1, wherein the predetermined range of movement is about 0.5 inches.

4. The backpack vacuum cleaner motor mounting assembly of claim 1, wherein the one or more springs comprise a plurality of coil springs.

5. The backpack vacuum cleaner motor mounting assembly of claim 1, wherein the one or more springs comprise one or more integrated spring/dampers.

6. The backpack vacuum cleaner motor mounting assembly of claim 5, wherein the one or more integrated spring/dampers comprise elastomeric materials having spring-like properties and damper-like properties.

7. The backpack vacuum cleaner motor mounting assembly of claim 1, further comprising one or more damper assemblies operatively positioned between the first housing and the suspension housing, the one or more damper assemblies being configured to generate a damping force in response to a relative movement between the suspension housing and the first housing.

8. The backpack vacuum cleaner motor assembly of claim 7, wherein the one or more damper assemblies comprise a plurality of damper assemblies, each damper assembly comprising:

a damper cylinder;

a damper piston at least partially contained within the damper cylinder and slideable relative to the damper cylinder along the suspension direction, the damper cylinder and damper piston forming a generally enclosed space therebetween; and an orifice in fluid communication with the generally enclosed space and configured to allow air to enter and leave the generally enclosed space;

wherein one of the damper cylinder and the damper piston is connected to and movable with the suspension housing.

9. The backpack vacuum cleaner motor mounting assembly of claim 7, wherein the one or more springs comprise a plurality of springs, and the one or more damper assemblies comprise a plurality of damper assemblies.

10. The backpack vacuum cleaner motor mounting assembly of claim 9, wherein at least one of the plurality of springs or the plurality of damper assemblies is arranged to generally surround a center of gravity of the suction motor.

11. The backpack vacuum cleaner motor mounting assembly of claim 10, wherein the one or more springs and the center of gravity of the suction motor are located at substantially the same position along the suspension direction.

12. The backpack vacuum cleaner motor mounting assembly of claim 1, wherein the suction motor inlet is in sealed fluid communication with the air inlet when the suspension housing is in the first position, and is not in sealed fluid communication with the air inlet when the suspension housing is in the second position.

13. The backpack vacuum cleaner motor mounting assembly of claim 1, wherein the suction motor inlet faces the air inlet.

14. The backpack vacuum cleaner motor mounting assembly of claim 1, further comprising a motor gasket located between the suction motor inlet and the air inlet, the motor gasket forming a seal between the suction motor inlet and the air inlet when the suspension housing is in the first position.

15. The backpack vacuum cleaner of claim 14, wherein the motor gasket is connected to and movable with the suspension housing.

16. The backpack vacuum cleaner of claim 1, further comprising one or more sound-absorbing inserts positioned between the first housing and the suspension housing.

17. The backpack vacuum cleaner of claim 16, wherein the one or more springs comprise a plurality of springs arranged radially around the suspension housing, and the one or more sound-absorbing inserts comprise one or more walls arranged radially around the suspension housing, the walls being located between adjacent springs.

18. The backpack vacuum cleaner motor mounting assembly of claim 1, wherein:

the suspension housing comprises an enclosure that generally encloses the suction motor outlet except for one or more openings located on a first side of an axial centerline of the suction motor; and the air outlet is located on a second side of the axial centerline of the suction motor, the second side being opposite the first side.

19. A backpack vacuum cleaner module comprising:

a filtration chamber having a filtration chamber inlet and a filtration chamber outlet, the filtration chamber inlet being configured for connection to a suction hose;

a motor module housing having a motor module inlet in fluid communication with the filtration chamber outlet, and a motor module outlet;

a suspension chamber located in the motor module housing and in fluid communication between the motor module inlet and the motor module outlet;

a suspension housing at least partially contained within the suspension chamber, the suspension housing being configured to move a predetermined distance, relative to the suspension chamber, along a suspension direction from a first position to a second position, and the suspension housing being substantially restricted from moving, relative to the suspension chamber, perpendicular to the suspension direction;

a suction motor connected to and movable with the suspension housing, the suction motor having a suction motor inlet in fluid communication with the motor module inlet and a suction motor outlet in fluid communication with the motor module outlet;

one or more springs operatively positioned between the motor module housing and the suspension housing, the one or more springs being oriented to bias the suspension housing from the second position towards the first position;

one or more damper assemblies operatively positioned between the motor module housing and the suspension housing, the one or more damper assemblies being configured to generate a damping force in response to a relative movement between the suspension housing and the motor module housing;

the one or more damper assemblies comprising a plurality of damper assemblies, each damper assembly comprising:

a damper cylinder;

a damper piston at least partially contained within the damper cylinder and slideable relative to the damper cylinder along the suspension direction, the damper cylinder and damper piston forming a generally enclosed space therebetween; and an orifice in fluid communication with the generally enclosed space and configured to allow air to enter and leave the generally enclosed space;

wherein one of the damper cylinder and the damper piston is connected to and movable with the suspension housing.

20. The backpack vacuum cleaner module of claim 19, wherein the backpack module comprises an exterior shell that encloses the filtration chamber, and the motor module housing is connected to the exterior shell.

21. The backpack vacuum cleaner module of claim 20, wherein the motor module housing is located essentially entirely inside the exterior shell.

22. The backpack vacuum cleaner module of claim 19, further comprising one or more damper assemblies operatively positioned between the suspension chamber and the motor module housing.

23. A backpack vacuum cleaner motor mounting assembly comprising:

a first housing having an air inlet, an air outlet, and a suspension chamber located inside the first housing;

a suspension housing at least partially contained within the suspension chamber, the suspension housing being configured to slide through a predetermined range of movement during an impact, relative to the suspension chamber, along a suspension direction from a first position to a second position, and the suspension housing being substantially restricted from moving, relative to the suspension chamber, perpendicular to the suspension direction;

a suction motor connected to and movable with the suspension housing, the suction motor having a suction motor inlet in fluid communication with the air inlet, and a suction motor outlet in fluid communication with the air outlet;

one or more springs operatively positioned between the first housing and the suspension housing, the one or more springs being oriented to bias the suspension housing from the second position towards the first position; and a sliding sealed passage between the suction motor inlet and the air inlet configured to slide along a sliding direction upon sliding of the suspension housing through the predetermined range of movement.

24. The backpack vacuum cleaner of claim 23, wherein the suction motor inlet is in sealed fluid communication with the air inlet via the sliding sealed passage when the suspension housing is in the first position, and is not in sealed fluid communication with the air inlet via the sliding sealed passage when the suspension housing is in the second position.

25. The backpack vacuum cleaner of claim 23, wherein the sliding sealed passage comprises a motor gasket located between the suction motor inlet and the air inlet, the motor gasket forming sealed fluid communication between the suction motor inlet and the air inlet with the suspension housing is in the first position.

26. The backpack vacuum cleaner of claim 23, wherein the sliding direction is parallel to the suspension direction.

* * * * *